US006148698A

United States Patent [19]

Hsieh

[11] Patent Number: 6,148,698

[45] Date of Patent: Nov. 21, 2000

[54] ANGLE-ADJUSTABLE BOX END WRENCH

[76] Inventor: Chih-Ching Hsieh, No. 64, Lane 107, Liang Tsun Rd., Fong Yuan City, Taichung Hsien, Taiwan

[21] Appl. No.: 09/520,169

[22] Filed: Mar. 7, 2000

[51] Int. Cl.[7] ..... B25B 23/16

[52] U.S. Cl. ..... 81/177.8; 403/91

[58] Field of Search ..... 81/177.8, 177.9, 81/177.7; 403/84, 91, 92, 97, 103, 79

[56] References Cited

U.S. PATENT DOCUMENTS

| | | | |
|---|---|---|---|
| 1,080,121 | 12/1913 | Oriol | 81/177.8 |
| 2,978,938 | 4/1961 | Nalley | 81/177.8 |
| 3,186,265 | 6/1965 | Wenturine et al. | 81/177.9 |
| 3,779,107 | 12/1973 | Avery | 81/177.8 |
| 4,901,608 | 2/1990 | Shieh | 81/177.8 |
| 4,929,113 | 5/1990 | Sheu | 403/84 |
| 5,581,838 | 12/1996 | Rocco | 403/91 |
| 5,943,925 | 8/1999 | Huang | 81/177.8 |

*Primary Examiner*—David A. Scherbel
*Assistant Examiner*—Joni B. Danganan
*Attorney, Agent, or Firm*—Varndell & Varndell, PLLC

[57] ABSTRACT

An angle-adjustable box end wrench, which includes a handle having a front coupling block and a transverse receiving open chamber, a box end pivoted to the front coupling block of the handle, the box end having two toothed portions disposed at two opposite sides of the front coupling block, a locking mechanism mounted in the transverse receiving open chamber and controlled to lock the box end, the locking mechanism including a long rod member and a short rod member longitudinally connected together and moved in and out of the receiving open chamber between the locking position and the unlocking position, the long rod member and the short rod member each having a toothed portion for engaging the toothed portions at the web area of the box end, a spring, which holds the long rod member and the short rod member in the locking position, and a screw threaded into a top screw hole on the handle and stopped at a flat shank portion at the long rod member to stop the long rod member from rotation.

4 Claims, 9 Drawing Sheets

ANGLE-ADJUSTABLE BOX END WRENCH

BACKGROUND AND SUMMARY OF THE INVENTION

The Present invention relates to an angle-adjustable box end wrench, and more particularly to a durable angle-adjustable box end wrench, which can be conveniently adjusted to change the angular position of the box end, and to hold the box end in the adjusted position positively.

A variety of wrenches, including box end wrenches, open end wrenches, hex wrenches, combination wrenches, etc. have been disclosed, and have appeared on the market. The working angle of these wrenches is not adjustable. There is known an angle-adjustable box end wrench, which enables the box end to be adjusted within 180° relative to the handle. This structure of angle-adjustable box end wrench comprises a handle, and a box end pivoted to the handle. The box end comprises a toothed portion projected from the web area thereof. The handle comprises a front blind hole, which holds a spring and a steel ball on the spring. The steel ball is forced by the spring into engagement with the toothed portion at the box end. When adjusting the angular position of the box end relative to the handle, the toothed portion is rubbed against the steel ball. Because the toothed portion is frequently rubbed against the steel ball, the toothed portion and the steel ball wear quickly with use. Further, because the steel ball is forced by the spring into engagement with the toothed portion at the web area of the box end to stop the box end in position, the box end tends to be forced out of position.

The present invention has been accomplished to provide an angle-adjustable box end wrench, which eliminates the aforesaid drawbacks. According to one aspect of the Present invention, the angle-adjustable box end wrench comprises a handle having a front coupling block and a transverse receiving open chamber, a box end pivoted to the front coupling block of the handle, the box end having two toothed portions disposed at two opposite sides of the front coupling block, a locking mechanism mounted in the transverse receiving open chamber and controlled to lock the box end, the locking mechanism including a long rod member and a short rod member longitudinally connected together and moved in and out of the receiving open chamber between the locking position and the unlocking position, the long rod member and the short rod member each having a toothed portion for engaging the toothed portions at the web area of the box end, and a spring, which holds the long rod member and the short rod member in the locking position. According to another aspect of the present invention, a screw threaded into a top screw hole on the handle and stopped at a flat shank portion at the long rod member to stop the long rod member from rotation.

DETAILED DESCRIPTION OF THE PREFERRED EMBODIMENT

Figure 1:
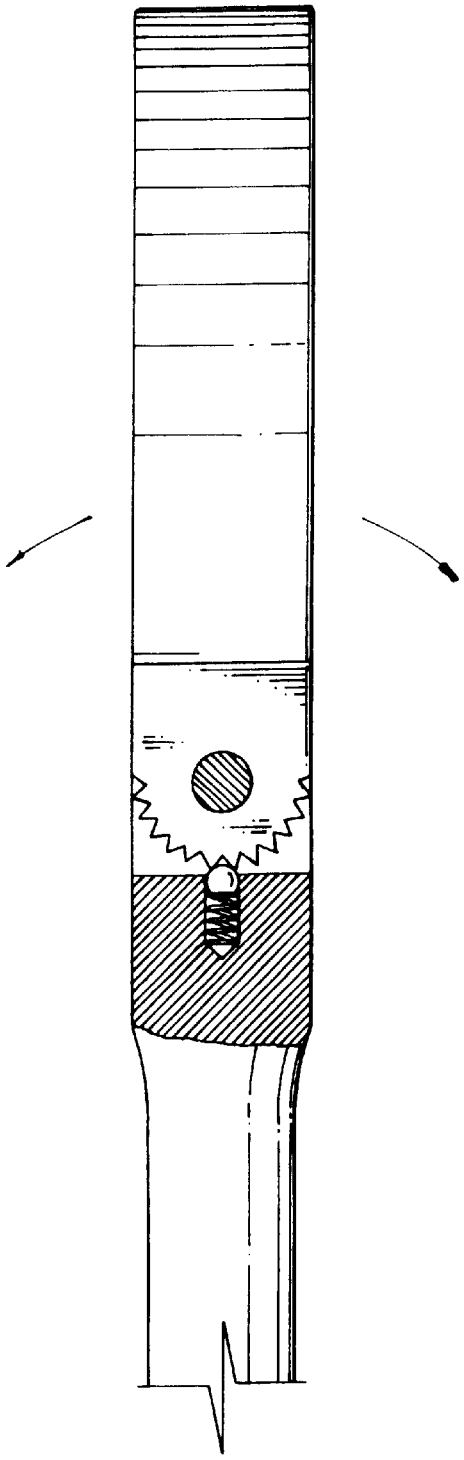
Fig. 1 PRIOR ART
FIG. 1 illustrates an angle-adjustable box end wrench according to the prior art.
Figure 2:
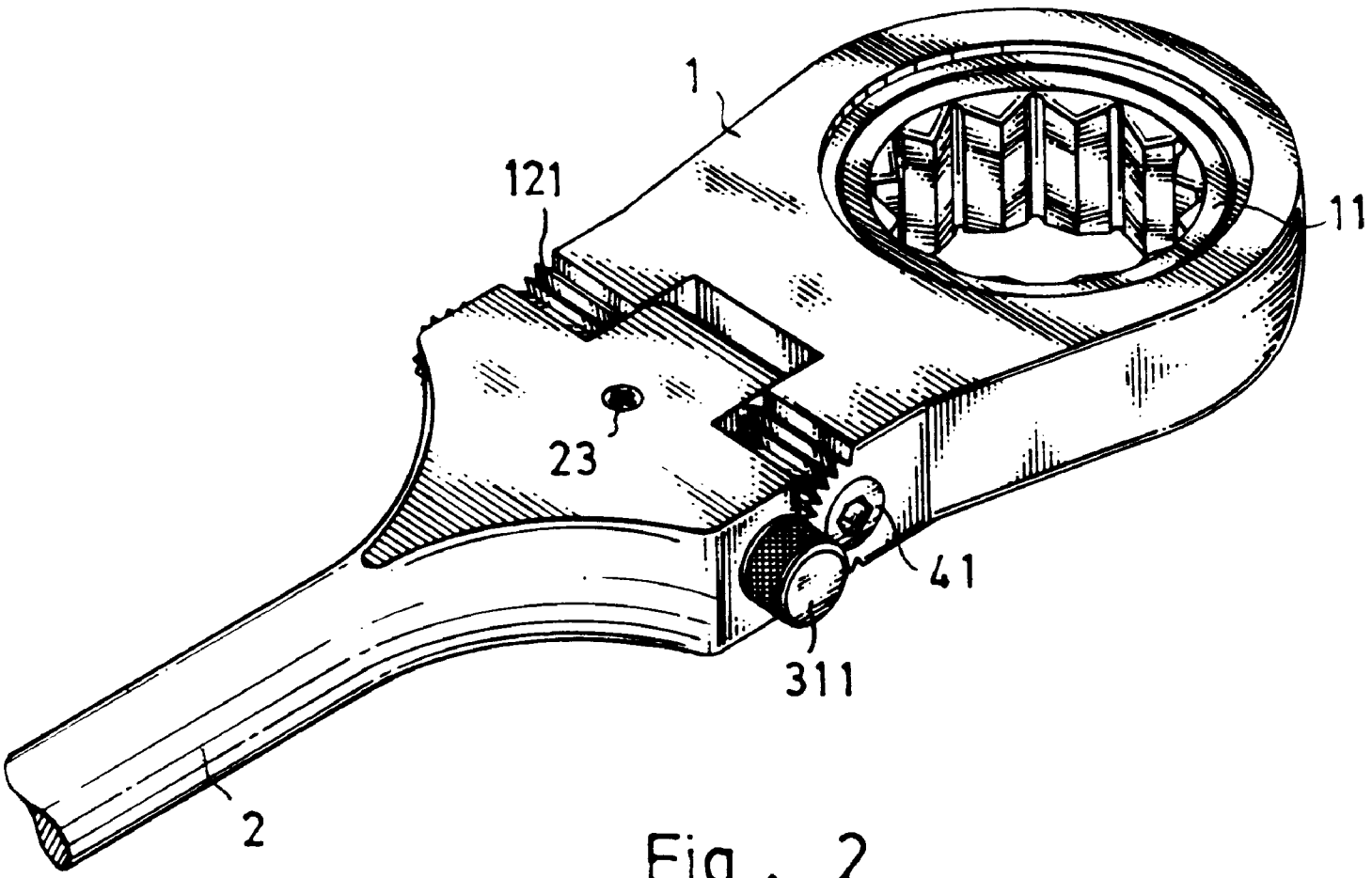
FIG. 2 is a perspective view of an angle-adjustable box end wrench according to the present invention.
Figure 3:
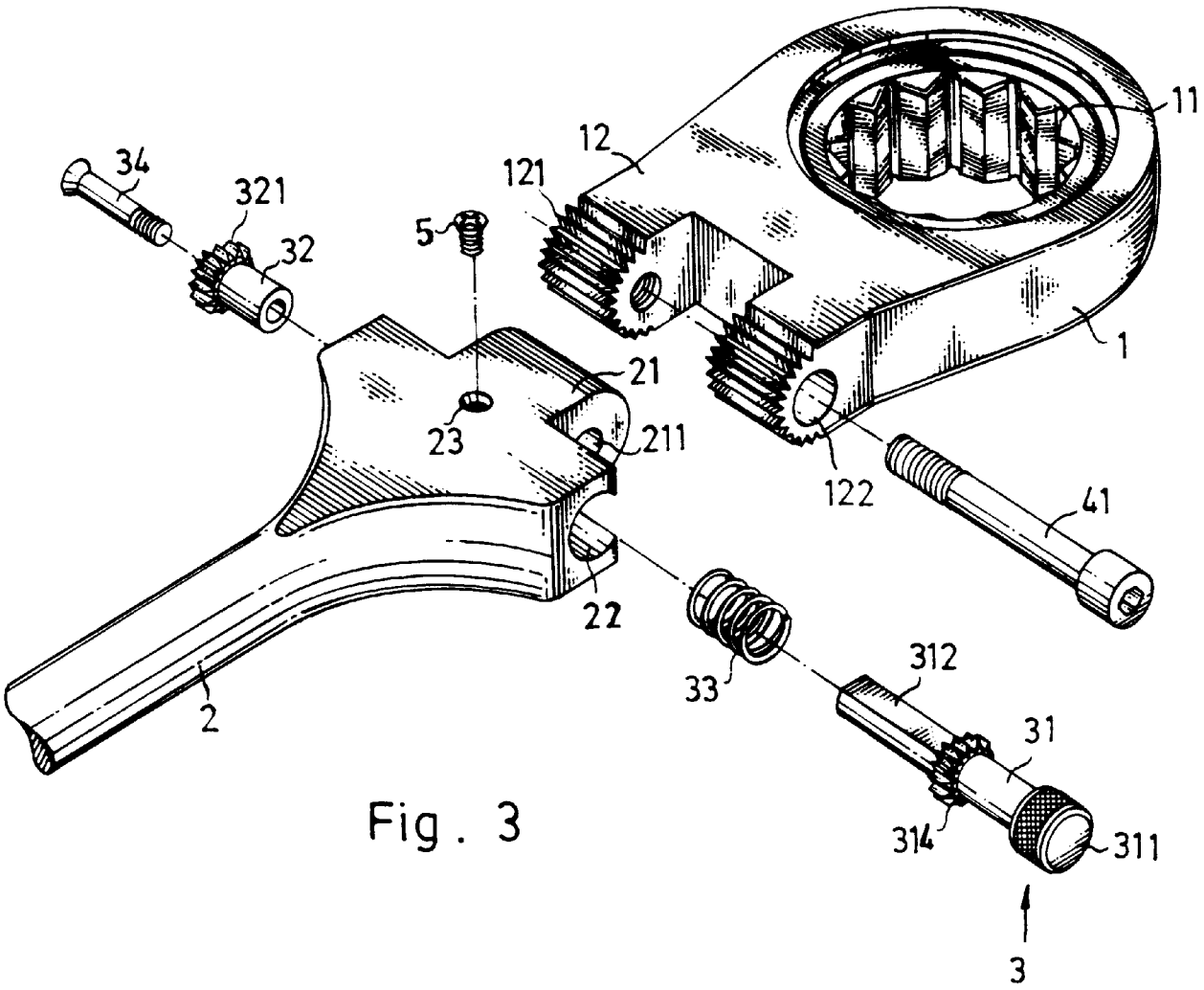
FIG. 3 is an exploded view of the angle-adjustable box end wrench shown in FIG. 2.
Figure 4:
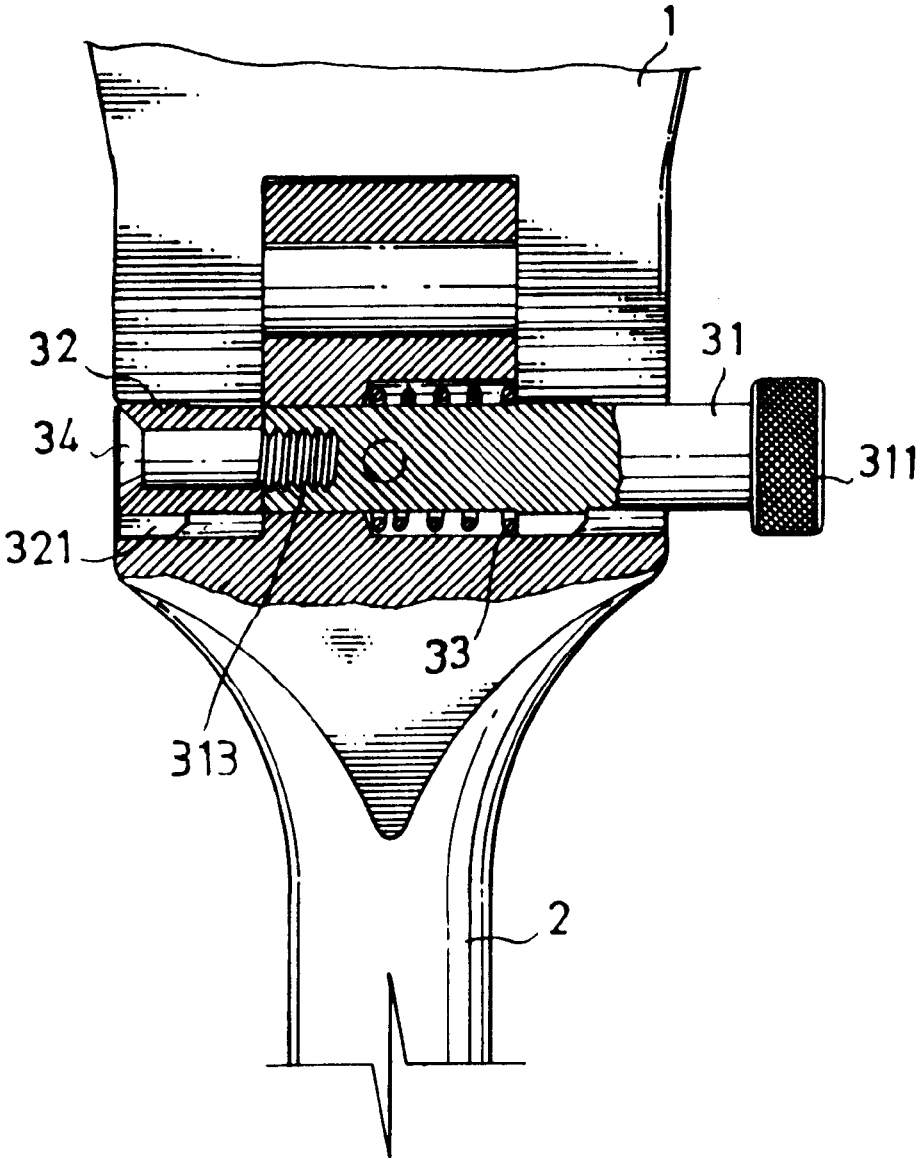
FIG. 4 is a sectional assembly view of the present invention showing the locking mechanism disposed in the locking position.
Figure 5:
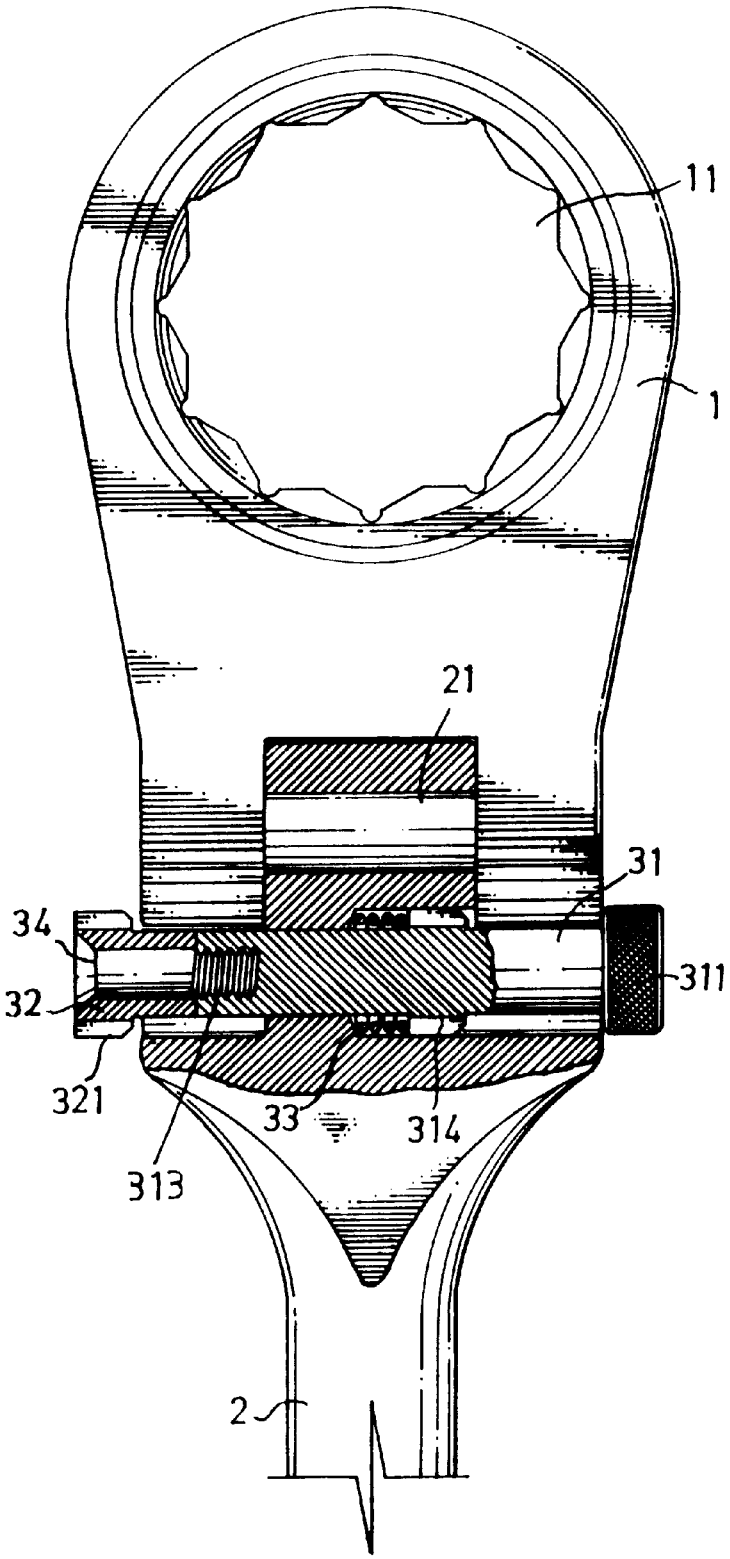
FIG. 5 is similar to FIG. 4 but showing the locking mechanism moved to the unlocking position.
Figure 6:
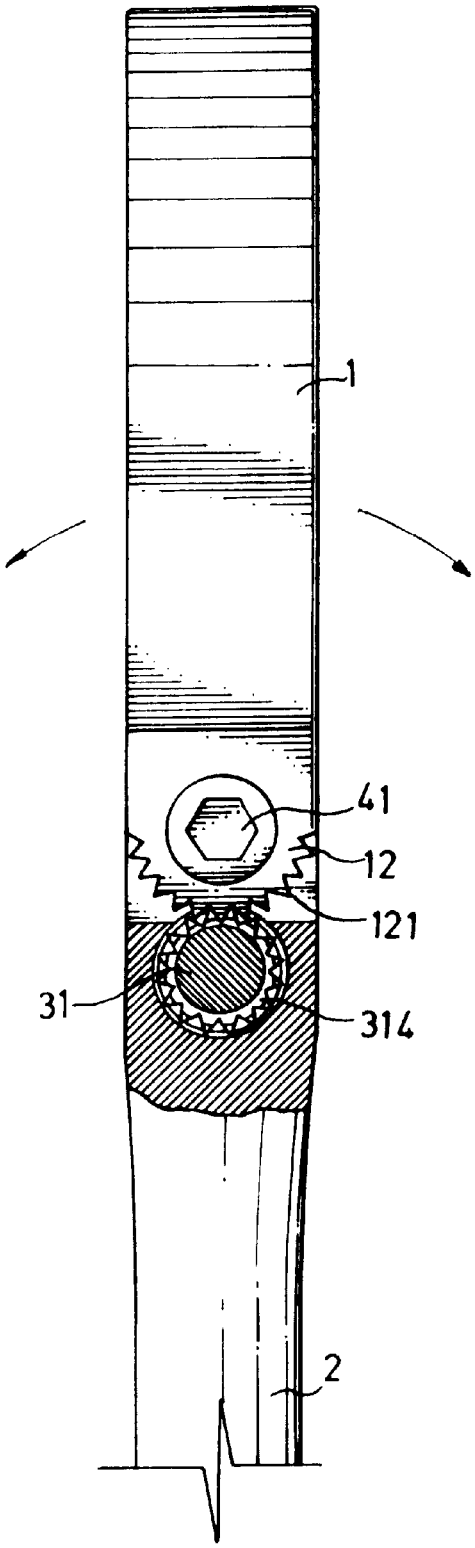
FIG. 6 is a right side view in section of the present invention.

Referring to Figures from 2 through 6, an angle-adjustable box end wrench in accordance with the present invention is generally comprised of a box end 1, a handle 2, and a locking mechanism 3. The box end 1 comprises a box 11, a substantially U-shaped web area 12, two axle holes 122 extended through the two distal ends of the U-shaped web area 12 and arranged in a line, and two toothed portions 121 respectively formed on the periphery of the two distal ends of the U-shaped web area 12. The box 11 has points in it so that can be positively attached to the workpiece. The handle 2 comprises a cylindrical front coupling block 21 inserted in between the two distal ends of the U-shaped web area 12, an axle hole 211 extended through the cylindrical front coupling block 21 and pivotally connected between the axle holes 122 on the two distal ends of the U-shaped web area 12 by a screw bolt 41 for enabling the box end 1 to be turned within 180° relative to the handle 2, a transverse receiving open chamber 22 disposed in parallel to the axle hole 211, and a top screw hole 23 disposed on the top side thereof in communication with the transverse receiving open chamber 22. The locking mechanism 3 is mounted in the receiving open chamber 22 and controlled to lock/unlock the box end 1, comprising a long rod member 31, a short rod member 32, a spring 33, and a screw 34. The long rod member 31 comprises a head 311 at one end, an axially extended screw hole 313 at an opposite end, a flat shank portion 312, and a toothed portion 314 disposed around the periphery for engagement with one toothed portion 121 at one end of the U-shaped web area 12. The short rod member 32 is a tubular member having a toothed portion 321 raised around the periphery of one end thereof for engagement with one toothed portion 121 at one end of the U-shaped web area 12. The spring 33 is sleeved onto the flat shank portion 312 of the long rod member 31, and stopped between the toothed portion 314 of the long rod member 31 and a step (not shown) inside the cylindrical receiving open chamber 22. The screw 34 is inserted through the short rod member 32, and threaded into the screw hole 313 on the long rod member 3 to secure the long rod member 31 and the short rod member 32 together.

Figure 7:
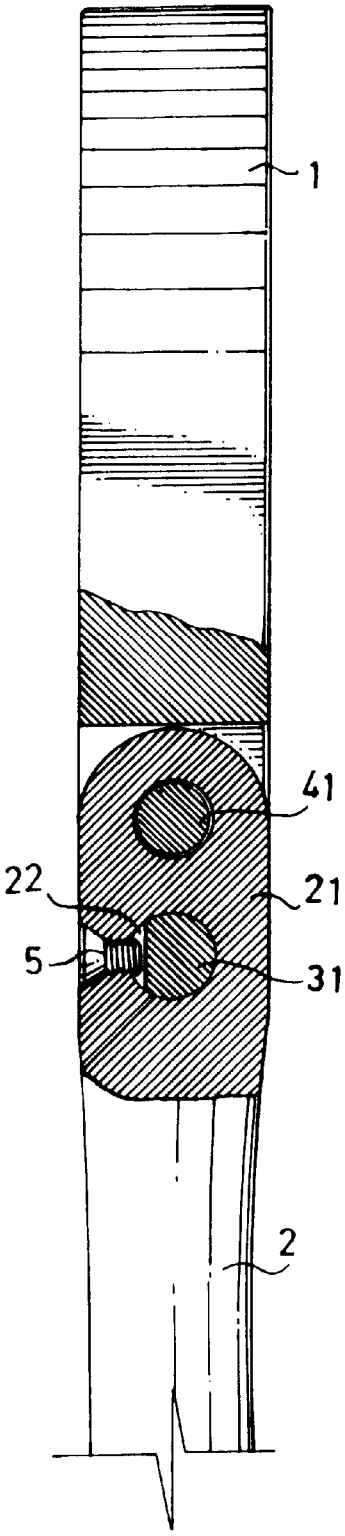
FIG. 7 is a left side view in section of the present invention.

The assembly process of the present invention is outlined hereinafter. The spring 33 is sleeved onto the flat shank portion 312 of the long rod member 31, and then the long rod member 31 is inserted with the spring 33 into the transverse receiving open chamber 22, and then the screw 34 is inserted through the short rod member 32 and threaded into the screw hole 313 on the long rod member 31 to secure the long rod member 31 and the short rod member 32 together, enabling the toothed portion 321 of the short rod member 32 and the toothed portion 314 of the long rod member 31 to be meshed with the toothed portions 121 at the U-shaped web area 12, and then a holding down screw 5 is threaded into the top screw hole 23 and stopped at the flat shank portion 312 of the long rod member 31 to stop the long rod member 31 from rotary motion in the receiving open chamber 22 (see FIG. 7).

Figure 8:
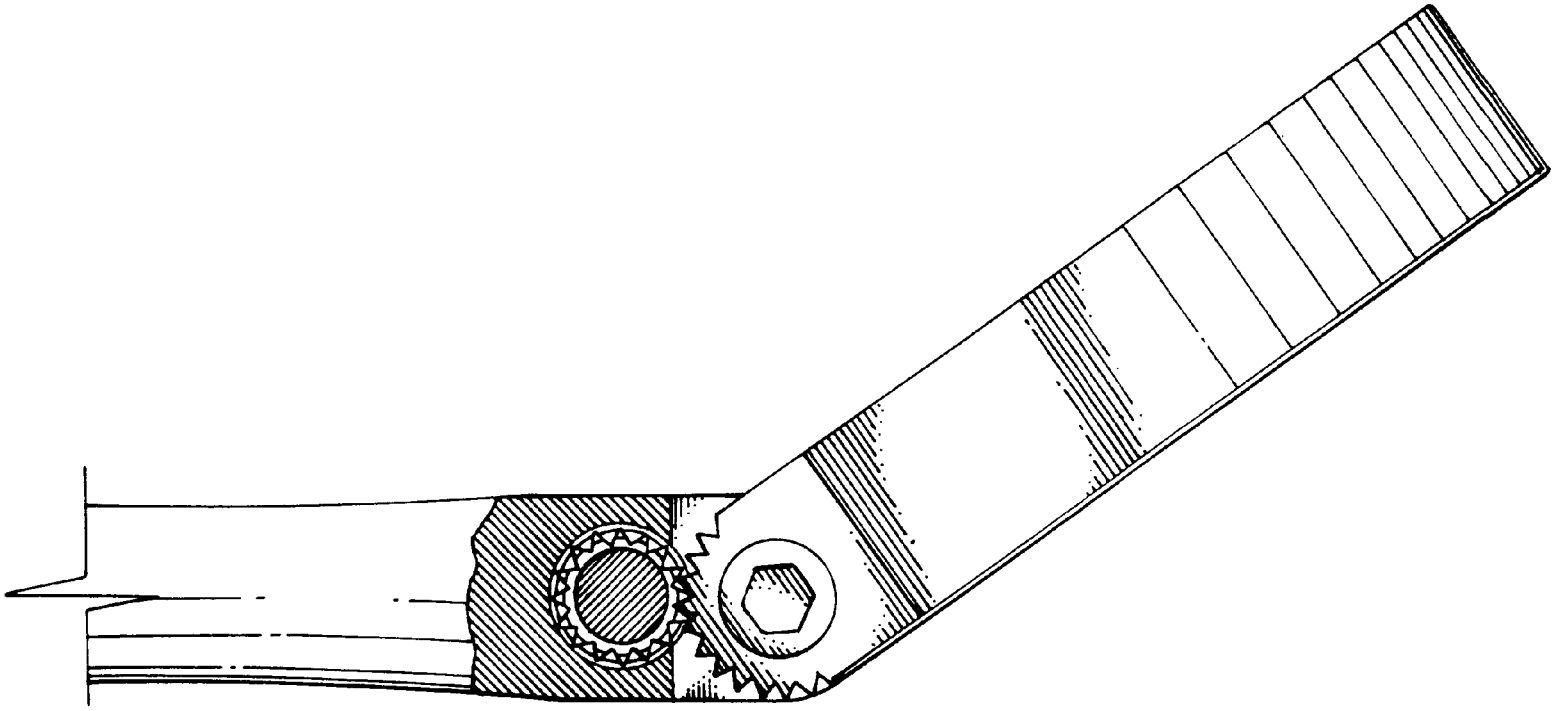
FIG. 8 shows the box end adjusted in one direction according to the present invention.
Figure 9:
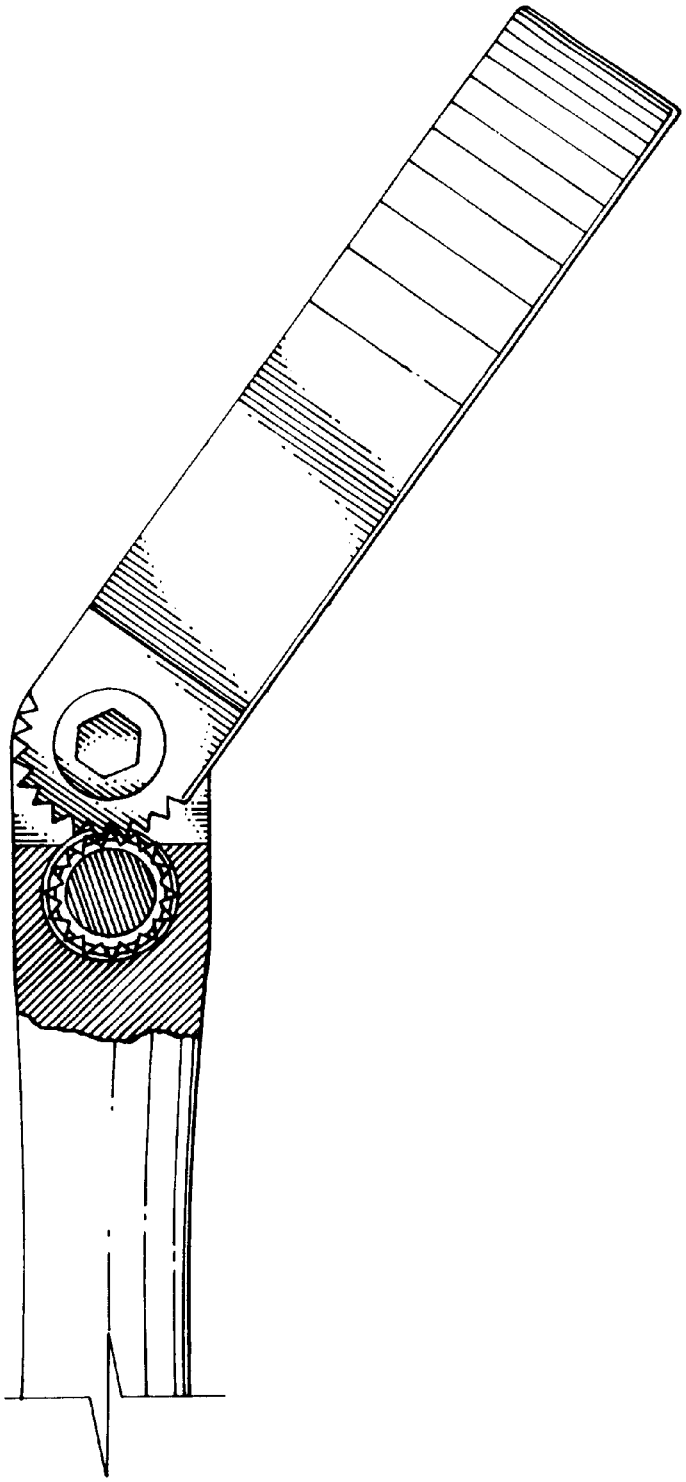
FIG. 9 shows the box end adjusted in the reversed direction according to the present invention.

Referring to FIGS. 8 and 9, when adjusting the angular position of the box end 1 at the handle 2, the head 311 of the long rod member 31 is pushed with the thumb to compress the spring 33, and to force the toothed portions 321 of the short rod member 32 and the toothed portion 314 of the long rod member 31 away from the toothed portions 121 at the U-shaped web area 12, enabling the box end 1 to be turned relative to the handle 2 to the desired angle. After adjustment, the thumb is released from the head 311 of the long rod member 31, enabling the long rod member 31 and the short rod member 32 to be pushed back to their former position in engagement with the toothed portions 121 at the U-shaped web area 12.

While only one embodiment of the present invention has been shown and described, it will be understood that various modifications and changes could be made thereunto without departing from the spirit and scope of the invention disclosed.

What is claimed is:

1. An angle-adjustable box end wrench comprising a handle, said handle comprising a front coupling block, a box end pivoted to the front coupling block of said handle, said box end comprising a box, a substantially U-shaped web area, two axle holes extended through two distal ends of said U-shaped web area and pivotally connected to the front coupling block of said handle at two opposite sides, a first toothed portion and a second toothed portion respectively formed on the periphery of the two distal ends of said U-shaped web area, pivot means mounted in the axle holes on the two distal ends of said U-shaped web area and installed in the front coupling block of said handle for enabling said box end to be turned within 180° relative to said handle, and a locking mechanism mounted in said handle and controlled to engage the toothed portions at said U-shaped web area and to lock said box end, wherein said handle comprises a transverse receiving open chamber disposed adjacent to said front coupling block for holding said locking mechamism; said locking mechanism comprises a long rod member moved in and out of said transverse receiving open chamber at one end, said long rod member comprising a toothed portion raised around the periphery thereof for engagement with the first toothed portion at said U-shaped web area of said box end, a short rod member moved with said long rod member in and out of said transverse receiving open chamber at an opposite end, said short rod member comprising a toothed portion raised around the periphery thereof for engagement with the second toothed portion at said U-shaped web area of said box end, a fastening element fastened to said short rod member and said long rod member to fix said short rod member and said long rod member together, and spring means mounted around said long rod member and stopped between the toothed portion at said long rod member and a step inside the receiving open chamber in said handle to force the toothed portion of said long rod member and the toothed portion of said short rod member into engagement with the first toothed portion and second toothed portion at said web area of said box end.

2. The angle-adjustable box end wrench of claim 1 wherein said long rod member comprises a flat shank portion, and said handle comprises a top screw hole and a holding down screw threaded into said top screw hole and stopped at the flat shank portion to stop said long rod member from rotary motion in said receiving open chamber.

3. The angle-adjustable box end wrench of claim 1 wherein said short rod member is a tubular member, and said fastening element is inserted through said tubular short rod member and fastened to one end of said long rod member.

4. The angle-adjustable box end wrench of claim 3 wherein said long rod member comprises a screw hole axially extended at one end thereof, and said fastening element is a screw inserted through said tubular short rod member and threaded into the screw hole on said long rod member.

* * * * *